United States Patent [19]

Schuander

[11] 4,101,023

[45] Jul. 18, 1978

[54] RING BOX WITH REMOVABLE DISPLAY STAND

[75] Inventor: Eric Schuander, South Orange, N.J.

[73] Assignee: The Alsten Company, Jersey City, N.J.

[21] Appl. No.: 844,044

[22] Filed: Oct. 20, 1977

Related U.S. Application Data

[63] Continuation-in-part of Ser. No. 777,930, Mar. 15, 1977, abandoned.

[51] Int. Cl.[2] ..... B65D 1/34; B65D 5/50

[52] U.S. Cl. ..... 206/45.19; D9/235; D87/1 B; 206/566; 220/4 B

[58] Field of Search ..... 206/44.11, 44.12, 45.13, 206/45.14, 45.19, 301, 459, 303, 566, 594; 220/4 B, 4 E, 335, 17, 63 R; D9/235; D87/1 B; 221/44 R

[56] References Cited

U.S. PATENT DOCUMENTS

| | | | |
|---|---|---|---|
| D. 151,956 | 12/1948 | Baud | D9/235 |
| D. 185,825 | 8/1959 | Braun | D9/235 |
| 2,620,084 | 12/1952 | Prew | 220/335 |
| 2,788,123 | 4/1957 | Levis et al. | 206/566 |
| 3,164,284 | 1/1965 | Bergh et al. | 220/4 B |
| 3,381,873 | 5/1968 | Hirota | 206/592 |
| 3,416,655 | 12/1968 | Shiffman | 220/335 |
| 3,930,576 | 1/1976 | Stephens | 206/45.11 |

*Primary Examiner*—William Price
*Assistant Examiner*—Bruce H. Bernstein
*Attorney, Agent, or Firm*—J. B. Felshin

[57] ABSTRACT

This box comprises a case, and a cover hinged to the case at the rear of the box with the lower end of the cover spaced above the upper end of the case to leave a space therebetween when the cover is swung down toward the case. A display stand is removably fitted into the case and has an outwardly extending flange of uniform height, at the front, sides and rear thereof, interposed between the front, side and rear walls of the case and cover when the box is closed, to retain the case and cover in spaced parallel relation. The flanges of the display stand are exposed to view when the cover is closed. A sign holder is removably mounted and frictionally held on the display stand and comes out of the box with the display stand when the latter is removed from the box, to display the ring or other piece of jewelry to be displayed, and also to display the sign holder. The case and cover are substantially symmetrically disposed on opposite sides of said flanges. The case and cover are hinged together by a spring hinge. The case and cover and hinge are cooperatively constructed to hold facing portions of the case and cover in spaced relation to each other, one above the other, with the cover slanting downwardly and forwardly toward the case when the display stand is removed, so as to provide an open space between said facing portions. When the display stand is in the case and the cover is swung down, the flanges of the display stand are contacted by the facing portions of the case and cover and maintain the facing portions in parallel spaced relation.

10 Claims, 14 Drawing Figures

RING BOX WITH REMOVABLE DISPLAY STAND

This application is a Continuation-In-Part of U.S. Ser. No. 777,930, filed Mar. 15, 1977, now abandoned.

This invention relates to boxes for displaying rings or other articles of jewelry.

An object of this invention is to provide a box of the character described comprising a case, and a cover hinged to said case, and a display stand removably mounted in the case and having exposed portions disposed between the cover and case to keep said case and cover in spaced parallel relation.

Another object of this invention is to provide a box of the character described comprising a case section and a cover section, hinged to case section, said sections each having front, side and rear walls, with the upper edges of the walls of the case section disposed in alignment with and spaced below the upper edges of the walls of th cover section, when the cover section is swung down toward the case section, and with the display stand in the case, one of said sections having a tongue on its rear wall extending to the rear wall of said other section and swingably engaging the same.

Still another object of this invention is to provide in a box of the character described, a removable display stand having means to removably support a ring or other article of jewelry in display fashion, said display stand having at its front, side and rear, flange portions extending outwardly and interposed between the adjacent edges of the walls of said case and cover, such flanges having outer faces exposed to view when the box is closed, and holding the case and cover in spaced parallel relationship.

Yet another object of this inention is to provide a box of the character described having a pop-out or removable display stand into which is removably and frictionally fitted a ring holder to display a ring, and a sign holder removably and frictionally held on said stand and held in place frictionally between said stand and ring holder.

A further object of this invention is to provide a sturdy box of the character described which shall be relatively inexpensive to manufacture, easy to handle and manipulate, which shall be attractive in appearance, which may display a ring or other article to be displayed, within the box and being so constructed that the display stand may be removed from the box to display the article outside the box, and said box being such that a sign can be mounted on the display stand either within the box or when the display stand is removed from the box, and said box being such that it can be closed, with parts of the display stand exposed between the case and cover when the box is closed, and which shall yet be practical and efficient to a high degree.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the claims.

Another object of this invention is to provide a box of the character described comprising a case section and a cover section pivotally connected to the case section by a spring hinge, said case section, cover section and spring hinge being cooperatively constructed to hold said cover section in downwardly and forwardly slanted position with respect to said case section, when the display stand is removed from the box and the cover section is swung down.

IN THE DRAWINGS

Figure 1:
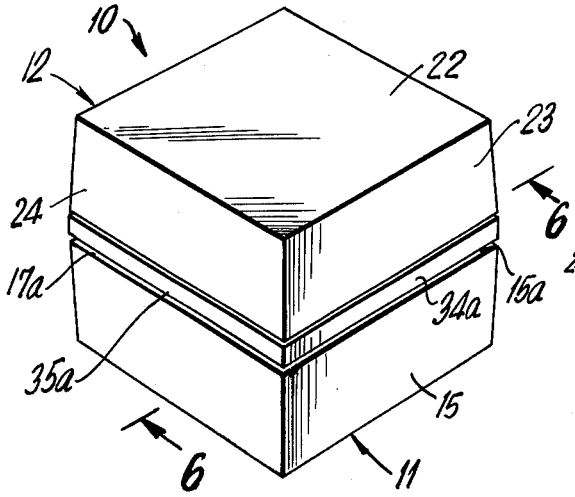
FIG. 1 is a top front perspective view of a box embodying the invention and showing the box in closed condition.
Figure 2:
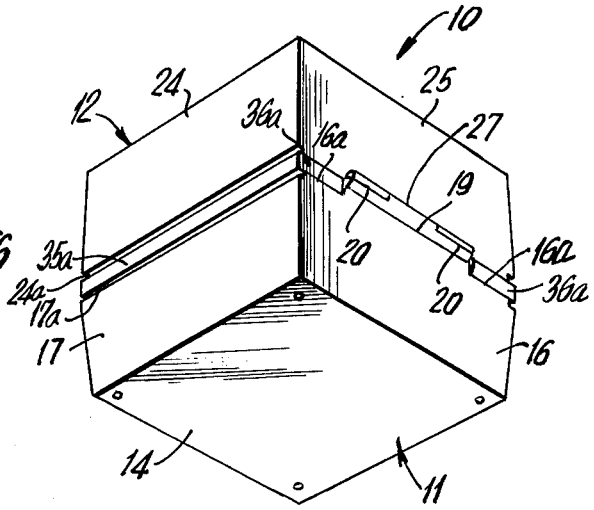
FIG. 2 is a rear bottom perspective view of the box of FIG. 1.
Figure 3:
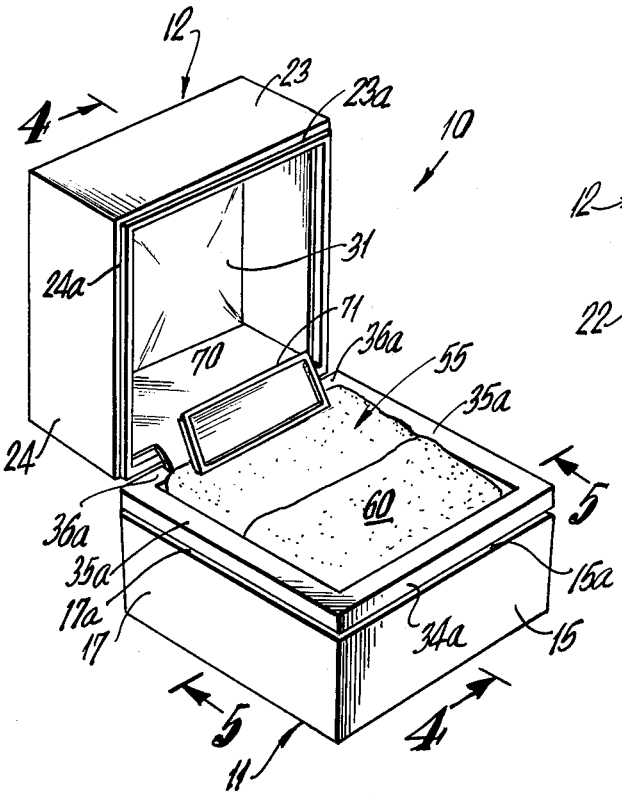
FIG. 3 is a front top perspective view of the box in open condition, with the removable display stand in the box and carrying the sign.
Figure 4:
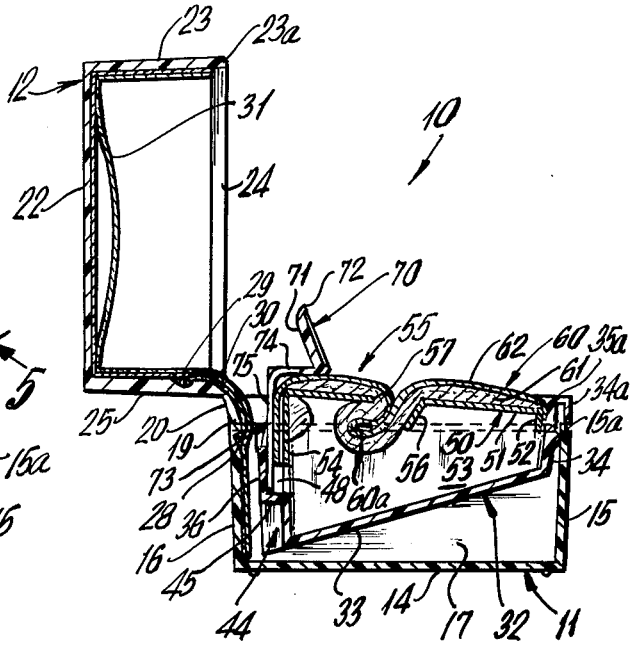
FIG. 4 is a cross-sectional view taken on line 4—4 of FIG. 3.
Figure 5:
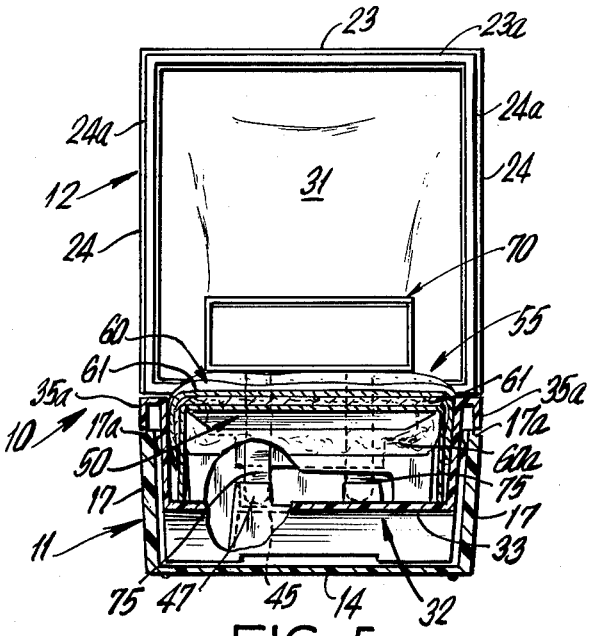
FIG. 5 is a cross-sectional view taken on line 5—5 of FIG. 3.
Figure 6:
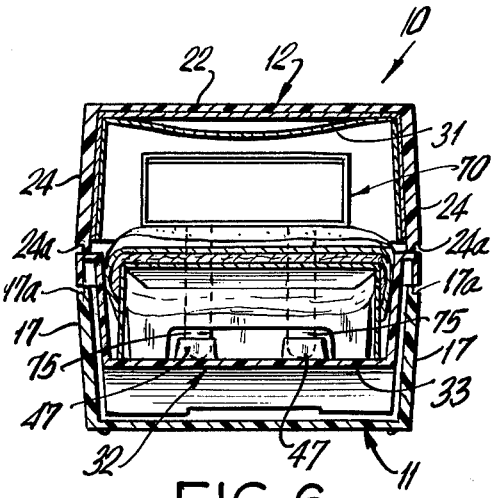
FIG. 6 is a cross-sectional view taken on line 6—6 of FIG. 1.
Figure 7:
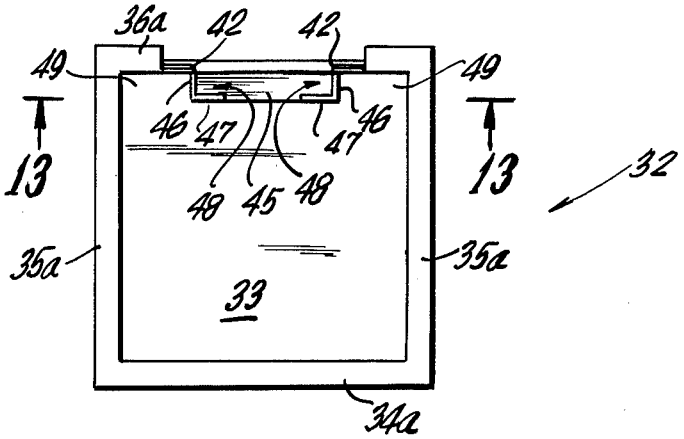
FIG. 7 is a top-plan view of the display stand removed from the box and with the sign and ring holder removed from the display stand.
Figure 8:
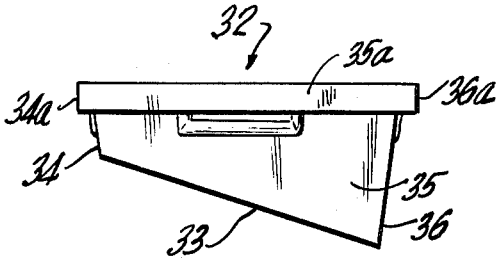
FIG. 8 is a side elevational view of the display stand of FIG. 7 with the top of the display stand in horizontal plane.
Figure 9:
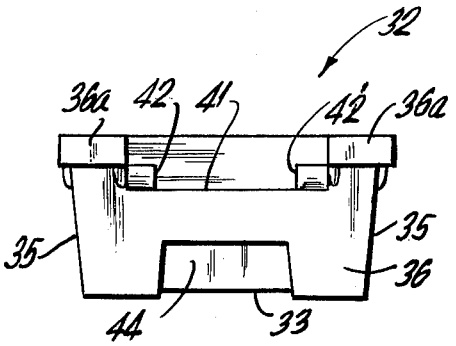
FIG. 9 is a rear end view of the display stand shown in FIG. 8.
Figure 10:
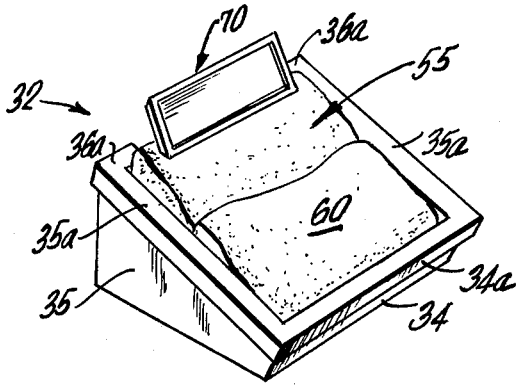
FIG. 10 is a top front persepctive view of the display stand in display position on a horizontal surface with the article holder and sign in place on the display stand.
Figure 11:
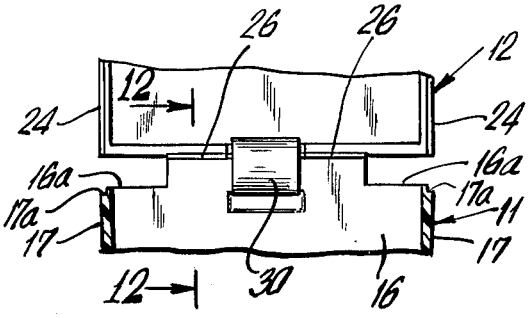
FIG. 11 is a partial front elevational view of the open box at the hinge between the case and cover, with the display stand removed from the box.
Figure 12:
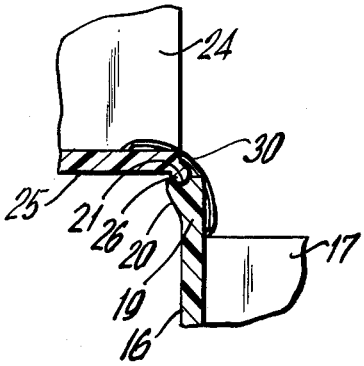
FIG. 12 is a cross-sectional view taken on line 12—12 of FIG. 11.
Figure 13:
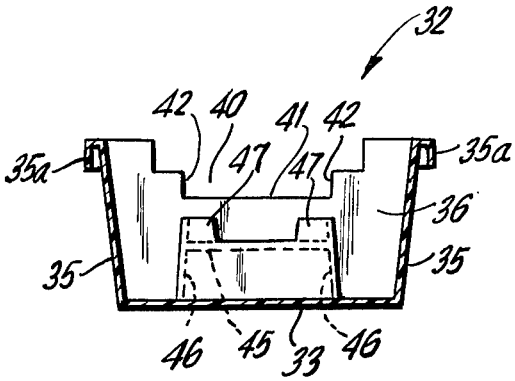
FIG. 13 is a cross-sectional view taken on line 13—13 of FIG. 7.

Referring now in detail to the drawing, 10 designates a box embodying the invention for housing rings and other articles of jewelry in the box and for displaying the same within the box and outside the box. Said box 10 comprises a case 11 to which a cover 12 is hinged, in the manner hereinafter explained. Said case 11 has a horizontal bottom wall 14 from which a front wall 15 extends upwardly. Also extending upwardly from the bottom wall 14, is a rear wall 16 and side walls 17. The case may be molded of plastic or other suitable material. The walls 15, 16, 17 are preferably inclined upwardly and outwardly.

The upper ends of side walls 17 and front wall 15 are stepped down at their outer sides as shown at **17*a* and 15*a* respectively, to form outer horizontal shoulders. The rear wall 16 has a central upwardly extending central wall 19 projecting above the upper edges 16*a*** of said rear wall disposed on opposite sides of said central wall and at the level of the upper edges of the side and front walls of the case.

At the central part of said central wall is a somewhat upwardly and rearwardly inclined lip 20 and on opposite sides of lip 20 are grooves 21 for the purpose hereinafter appearing.

The cover 12 has a top wall 22 which is horizontal when the cover is closed and a display stand, to be described, is in the case. Extending down from top wall 22 is a front wall 23, side walls 24 and a rear wall 25 which are substantially symmetrical to the front, side and rear walls, respectively, of the case, when the box is closed with the display stand in the case.

The rear wall 25 of the cover has at the central portion of its lower edge, spaced lips 26 rotatably engaged in the groove 21, and a central edge 27 between the lips 26, which clears the edge of the lip 20 of the wall 19.

At the inside of the lower end of wall 19 is a horizontal indentation or groove 28. At the inside of wall 19 is a similar horizontal indentation 29 coextensive with indentation 28. A curved metal overcenter spring 30 has ends hooked into the indentations 28, 29 which tend to keep the cover fully closed when the cover is pushed down on the case, or to keep the cover fully open when the cover is swung upwardly and rearwardly. This type of hinge is well known in the art.

However, in the present box, when the cover is brought down to horizontal position, the lower edges of the front, side and rear walls of the cover are spaced above the upper edges of the front, side and rear walls of the case, with said upper and lower edges in alignment with each other.

The lower edges of the front end side walls of the cover are stepped at their outer sides as shown at 23*a*, 24*a*, respctively, similarly to the indentations 15*a*, 17*a* of the case. The inner surfaces of the cover may be covered by a cloth inner lining 31 if desired.

Fitted into the case 11 is a display stand 32 which also may be moulded of plastic or the like material.

Said display stand 32 is open at the top and has a forwardly and upwardly slanting bottom wall 33 (when the stand is fitted into the case). Extending up from the front end of bottom wall 33, is a short upwardly and forwardly inclined wal 34, side upwardly and outwardly inclined wall 36. At the upper end of said front wall 34 is an outwardly extending flange 34*a*, adapted to rest on the upper edge of front wall 15. At the upper ends of side walls 35 are outwardly extending side flanges 35*a* resting in the upper edges of the side walls 17 of the case. At the upper end of rear wall 36 are short flanges 36*a* contacting upper edges of the rear wall 16 on opposite sides of the wall 19. Flanges 34*a*, 35*a*, 36*a* are all in the same plane and interconnected and of similar height throughout, and of a height to keep the cover in spaced parallel relation to the case when the box is closed with the display stand within the case. The outer surfaces of said flanges are in the respective planes of the outer sides of the upper and lower edges of the cover and case respectively, so that the indentations 15*a*, 17*a* and the indentations 23*a*, 24*a* of the cover can be seen on opposite sides of the front and side portions of the flanges, and the rear flange portions can be seen at opposite sides of the wall 19 when looking at the rear of the closed box.

When the cover is opened up, the stand remains in place within the case.

The rear wall 36 of the stand has an upper central cutaway 40 forming an upper edge 41 from the ends of which extend side edges 42. At the lower rear side of wall 36 is a recess 44, forming an upper horizontal wall 45 extending horizontally rearwardly from wall 36, side walls 46 extending from the bottom wall 33 up above wall 45 and coplanar spaced flanges 47 extending up from wall 45 and forming channels 48 between walls 36, 45, 46 and flanges 47 for the purpose hereinafter appearing. The central recess 44 forms vertical channels 49 with the rear wall 36 and side walls 35.

The display stand can be in the box when the box is open or closed, or the stand can be taken out of the case and placed on a table to rest on its bottom wall 33.

Figure 14:
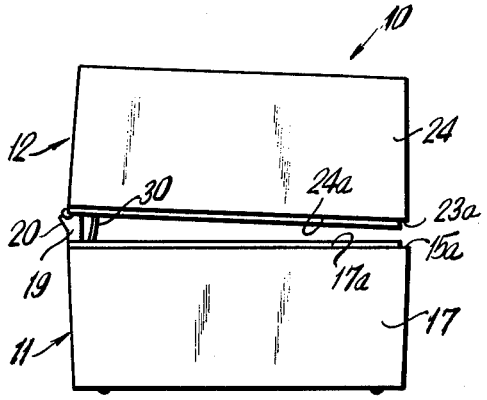
FIG. 14 is a side elevational view of the box with the display stand removed from the box.

When the display stand is removed from the box and the cover is swung down, spring 30 will move the cover to a position inclined downwardly and forwardly toward the case as shown in FIG. 14 of the drawing. When the display stand is in the case, and the cover then swung down, the flanges on the display stand, being of uniform height, hold the facing portions of the case and cover in spaced parallel relation, and the spring 30 presses the cover resiliently against the top of the flanges of the display stand.

A ring holder 55 of usual construction may be placed in the display stand. This ring holder comprises a cardboard frame 50 having a top section 51, a front flap 52, side flaps 53 and a rear flap 54. The top wall is slit to provide a downwardly extending flap 56 and forming a transverse slot 57. A soft pad 60 is applied to the top, side, front and rear of the frame. Said pad 60 comprises a soft backing cloth 61 from which a pile 62 extends outwardly. A folded back portion 60*a* of the pad is pushed through the slot 57. Some parts of the pad cover the top of the top wall 51 of the frame, and some parts cover the flaps 52, 53, 54. When the pad is mounted on the display stand, the flaps 52, 53, 54 are pushed into the stand contacting inner surfaces of the front, side and rear walls 34, 35, 36 of the stand. The top portion of the ringholder may slant downwardly and forwardly slightly. The ring holder 55 may be of usual well known construction. The portion 60*a* of the pad 60 which is pushed through the slot 57, forms a fold into which a ring or other articles of jewelry may be inserted to be held for display purposes.

The flanges 34*a*, 35*a* may be hollow comprising only horizontal webs extending outwardly from walls 34, 35, respectively, and walls extending downwardly from the webs in spaced parallel relation to the walls 34, 35, respectively. Flanges 36*a* may be solid.

A sign holder 70 may be frictionally fitted into the display stand as shown in the drawing. The sign holder comprises a rectangular plate 71 from which top, bottom and side flanges 72 project to form a frame. This plate is in an upwardly and rearwardly slanting plane when the sign holder is fitted into the stand. Extending rearwardly from the lower end of the plate 70 are a pair of similar fingers 73 each having an upper horizontal portion 74 from which a vertical tongue 75 projects downwardly. The tongues 75 are pressed down against the inner surface of the rear wall of the stand to project into the channels 48. The lower ends of tongue 75 contact the top of wall 45. The tongues are of such length that the plate 70 is disposed above the ring holder 55 and the portions 74 of the fingers 73 rest on the ring holder. Any suitable sign may be pasted to the front surface of the plate 71 inside the frame flanges 72.

It will now be understood that when the box is closed, outer surfaces of the flanges 34*a*, 35*a*, 36*a* may be seen from the outside, with grooves 15*a*, 16*a* between flanges 34*a*, 35*a* and the front and side walls 15, 17 of the case, and with grooves 23*a*, 24*a*, between said flanges and walls 23, 24 of the cover.

The flanges 34*a*, 35*a*, 36*a* furthermore fill in the space between the case and cover and hold said case and cover in parallel spaced relationship. The display stand 32 with the holder 55 and sign holder 70 may be fitted into the case, so as to display a ring or other article mounted on the pad, and the sign holder when the cover is raised up, or the display stand may be removed from the box and placed on a horizontal surface, to hold the pad in inclined position to display the ring or other article of jewelry in a manner to well display said article.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein as set forth or shown in the accompanying drawings is to be interpreted as illustrative.

I claim:

1. A box comprising:

(A) a case section, said case section including
  (i) a bottom wall and
  (ii) a peripheral wall, said peripheral wall extending upwardly and terminating in an upwardly facing edge portion, (B) a cover section, said cover section including
  (i) a top wall and
  (ii) a peripheral wall, said peripheral wall extending downwardly and terminating in a downwardly facing edge portion, (C) said upwardly facing edge portion of the case section and said downwardly facing edge portion of the cover section being in alignment, (D) spring hinge means rotatably joining the case section to the cover section, (E) said case and cover sections and said hinge means being cooperatively constructed to hold said facing edge portions of said sections disposed in spaced relation to each other, one above the other, with the downwardly facing edge portion of said cover slanting downwardly and forwardly toward the upwardly facing edge portion of the case, so as to provide a substantial open space between said facing edge portions when said cover section is swung down over said case section, and (F) a removable separately displayable display stand, said display stand including
  (i) a flange interposed between said case section and said cover section when the box is closed, said flange being of uniform height and being contacted by said facing edge portions and maintaining said edge portions in parallel spaced relation,
  (ii) the outer sides of said flange being exposed to view externally of the box when the box is closed.

2. A box as set forth in claim 1, wherein the display stand includes a holder removably carried by said stand, said holder having means to support an article for display.

3. The combination of claim 2, which further includes a sign holder removably mounted on said display stand and having a sign holding portion disposed above said article holder.

4. The combination of claim 3, said display stand having means to receive a portion of said sign holder.

5. The combination of claim 2, wherein said sections are rectangular and wherein the hinge includes an extension on one wall of one of said sections for supporting the axis of rotation of the hinge means in spaced relation to the edge of said one section.

6. The combination of claim 1, and facing edges of said walls having indentations at their outer sides to form grooves with said flanges at said edges.

7. The combination of claim 1, and a ring holder fitted in said stand.

8. The combination of claim 1, said stand having a bottom wall slanting upwardly and forwardly when the stand is in said box, and said stand being removable from the box and placeable on a horizontal surface with said slanting bottom wall contacting said horizontal surface and the top of the stand slanting downwardly and forwardly.

9. The combination of claim 8, and a ring holder on the display stand.

10. The combination of claim 9, and a sign holder frictionally fitted between the display stand and ring holder.

* * * * *